United States Patent [19]

Conti

[11] 4,135,373

[45] Jan. 23, 1979

[54] FULL-WIDTH SCOURING STATION PARTICULARLY FOR DELICATE PRINTED FABRICS

[76] Inventor: Fulvio Conti, Via Statuto 84, Bergamo, Italy

[21] Appl. No.: 727,191

[22] Filed: Sep. 27, 1976

[30] Foreign Application Priority Data

Oct. 3, 1975 [IT] Italy ..... 27980/75

[51] Int. Cl.[2] ..... D06B 1/02; D06B 15/02

[52] U.S. Cl. ..... 68/22 R; 68/205 R; 68/DIG. 5

[58] Field of Search ..... 68/DIG. 5, 205 R, 22 R, 68/62

[56] References Cited

U.S. PATENT DOCUMENTS

| | | | |
|---|---|---|---|
| 3,511,066 | 5/1970 | Fleissner | 68/62 X |
| 3,886,769 | 6/1975 | Conti | 68/DIG. 5 |

FOREIGN PATENT DOCUMENTS

| | | | |
|---|---|---|---|
| 1915403 | 10/1970 | Fed. Rep. of Germany | 68/22 R |
| 287419 | 3/1928 | United Kingdom | 68/205 R |

*Primary Examiner*—Philip R. Coe

*Attorney, Agent, or Firm*—Guido Modinao; Albert Josef

[57] ABSTRACT

A full-width scouring station particularly for delicate printed fabrics is described which comprises, within an outer housing, a tank containing a scouring liquid, at least one rotating drum, and a plurality of spray nozzles located above said drum and adapted to direct scouring liquid jets on a fabric resting on the drum, pumping means for supplying the scouring liquid to the spray nozzles and a drive means for rotating the drum.

1 Claim, 4 Drawing Figures

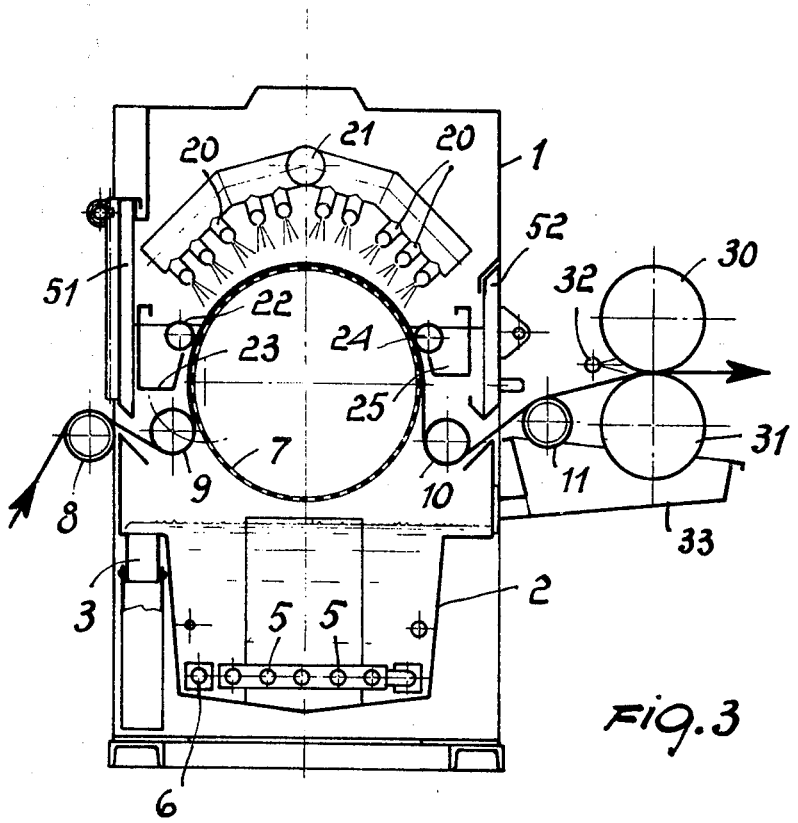
Fig. 3
Fig. 4
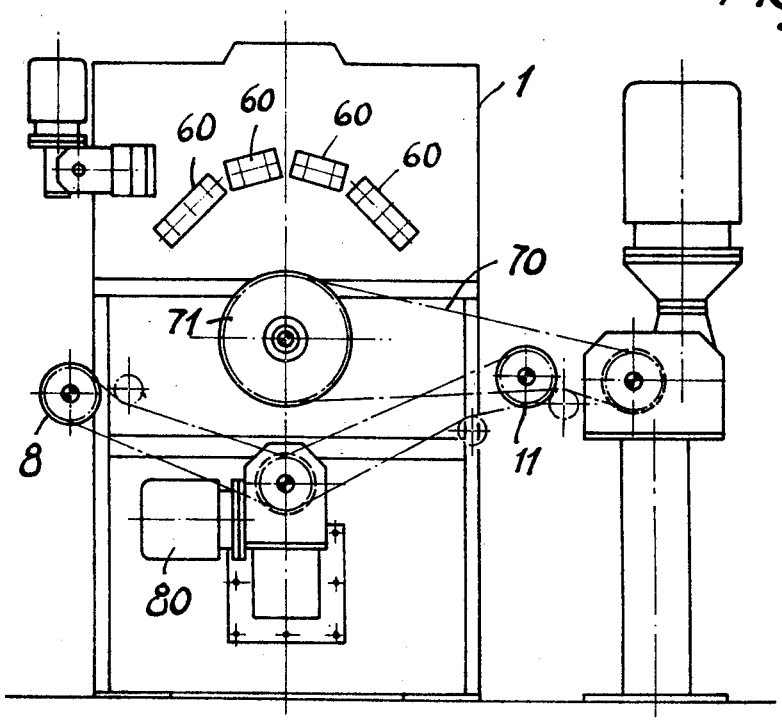

FULL-WIDTH SCOURING STATION PARTICULALY FOR DELICATE PRINTED FABRICS

BACKGROUND OF THE INVENTION

This invention relates to a full-width scouring station, particularly for use with delicate printed fabrics.

There are currently known various types of full-width fabric scouring stations; such known designs generally include a scouring tank, wherethrough the fabric being scoured is caused to pass which rests upon a rotating drum, spraying nozzles being further provided which act upon the fabric such as to remove impurities.

Such known types, while providing generally satisfactory results, have proved at times unsuitable for processing certain types of fabric; that is, it is not infrequent for the immersion of the fabric in the scouring liquid containing tank to adversely affect the fabric, especially where the scouring liquid itself is only imperfectly filtered.

Another drawback exhibited by the known designs is that the scouring jets are directed onto the fabric side corresponding to the reverse or opposite side to the side whereon the printing has been carried out, which tends to weaken the scouring action, since the scouring liquid jet, before it can act on the impurity or dye particles to be removed, has to pass through the fabric itself.

SUMMARY OF THE INVENTION

It is accordingly a primary object of this invention to eliminate such prior art drawbacks by providing a scouring station wherein the fabric may be subjected to strong handling without, however, involving any risk of the fabric getting distorted or in any way damaged.

It is another object of the invention to provide a scouring station wherein the fabric may be processed directly on the printed side, thus increasing the effectiveness of the scouring jets and ensuring that all of the excess dye particles is easily and quickly removed.

It is a further object of the instant invention to provide a scouring station which is easily obtainable from commercially available elements, requires no special maintenance, and is specially advantageous from a purely economical standpoint.

These and other objects, such as will be apparent hereinafter, are achieved by a full-width scouring station, particularly for delicate printed fabrics, according to the invention, characterized in that it comprises, within an outer housing, a tank containing a scouring liquid, at least one rotating drum having a substantially horizontal rotation axis extending over said tank, along at least a portion of said drum lateral surface there unrolling the fabric being scoured, a plurality of spray members located above said drum and operative to direct scouring liquid jets onto the fabric resting on said drum, a pumping means for supplying the scouring liquid to said spraying members, and a drive means for rotating said drum.

BRIEF DESCRIPTION OF THE DRAWINGS

Further features and advantages will be more apparent from the ensueing description of a preferred, though not exclusive, embodiment of a full-width scouring station particularly for delicate printed fabrics, shown by way of example and not of limitation in the accompanying drawings, where:

FIG. 3 shows a sectional view taken along the line III—III of FIG. 2; and

FIG. 4 is a side view of a scouring station.

DESCRIPTION OF THE PREFERRED EMBODIMENTS

Figure 1:
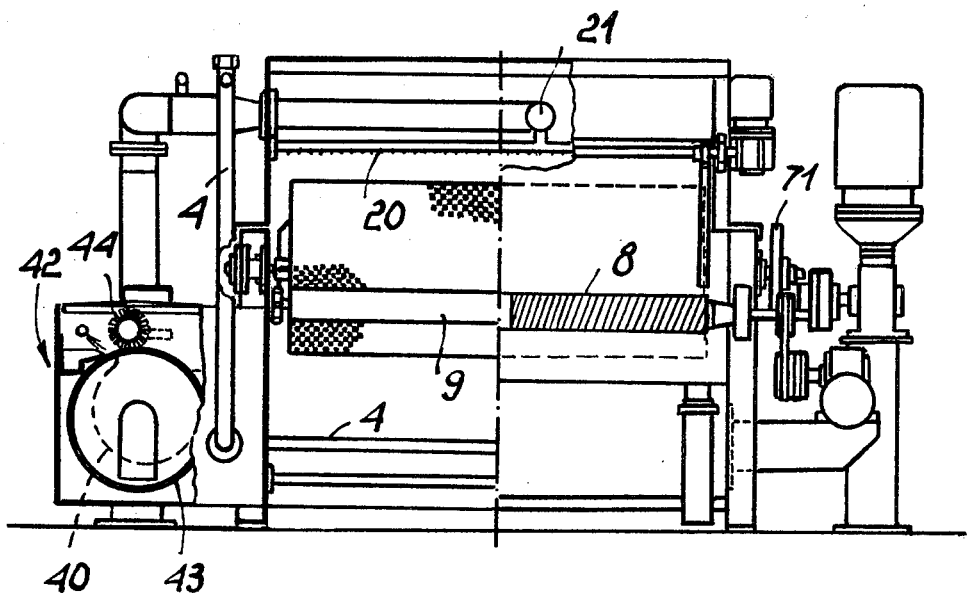
FIG. 1 is a partially cut-away elevational view.
Figure 2:
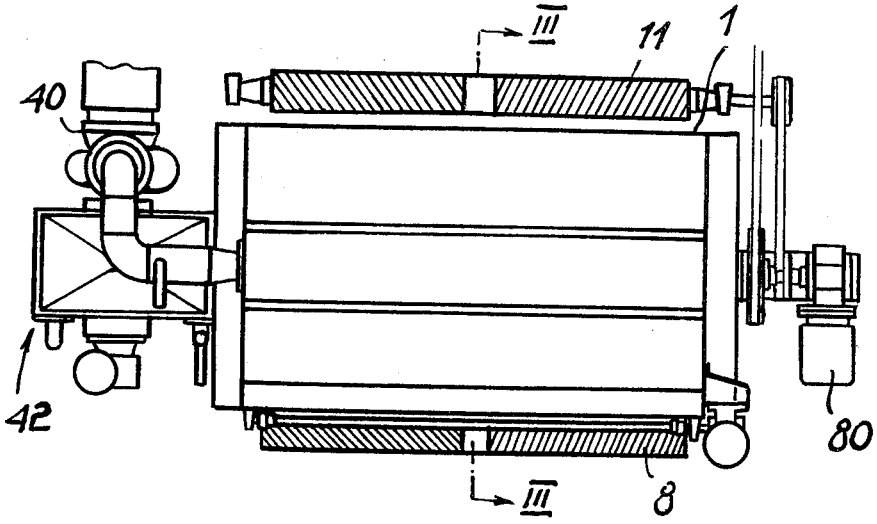
FIG. 2 is a top plan view of a scouring station according to the invention.

Making reference to the cited figures, the full-width scouring station according to the invention comprises an outer housing or casing 1, wherewithin a scouring tank 2 is located which contains the scouring liquid. The scouring liquid within the tank 2 is prevented from raising above a predetermined maximum level by an overflow canalization 3, and from dropping below a minimum level by a replenishment pipe 4. At the tank 2 bottom, an indirect steam-operated heater is provided comprised of a coil 5 wherethrough steam is circulated, as well as a direct steam-operated heater, comprising a pipe 6 supplying steam directly to the tank 2. The cited heaters serve the purpose of maintaining the desired temperature for the scouring liquid.

Located over the tank 2, there is a rotating drum 7 comprised of a horizontal axis hollow cylinder having its lateral surface perforated. Over the cylinder 7, and more precisely along the top portion of the cylinder 7 lateral surface, the fabric being scoured is made to unroll itself. In order to ensure close contact between the fabric and rotating drum 7, an inlet spreading roller 8 is provided external to the outer housing 1, which includes a roller member, lined with a covering layer of a material formed with a helix divided into two equal areas, each presenting a helix formation turning in opposite directions. Said spreading roller 8 is effective to spread the fabric along its width direction in order to remove any creases that may have formed during the preceding operations. After unrolling itself over the inlet spreading roller 8, the fabric runs over a first idle roller 9 located near the rotating drum 7, also with its axis parallel to that of the drum. In the proximity of the outlet from the outer housing 1, the fabric, after running over the upper portion or sector of the upper half of the drum 7, as already discussed above, runs over a second idle roller 10, also having its axis parallel with the drum 7, and thereafter over an outlet spreading roller 11, located external to the outer housing 1 and having design features entirely similar to the inlet spreading roller 8.

Inside the outer housing 1 and above the drum 7, a plurality of spray members are provided comprising pipes with holes 20 extending parallel to the rotating drum 7 axis and all communicating with a header or manifold 21 for the piping of the scouring liquid. The spray nozzles 20 are effective to direct jets of the scouring liquid onto the fabric resting, in the manner already described hereinabove, on the drum 7.

Upstream of said spray nozzles 20 with respect to the fabric direction of advance, there is provided a first squeezer roller 22 acting in contact with the drum 7, whereunder a deflector canalization 23 is located; downstream of the spray nozzles 20, a second squeezer roller 24 is provided, whereunder a second deflector canalization 25 is located. The squeezer rollers 22 and 24 perform a dual function, firstly of squeezing the fabric to improve the scouring action, and secondly, which is possibly more important still, of deflecting the scouring liquid delivered downwards by the spray nozzles 20 in order to prevent it, from falling onto the underlying fabric to form pockets therein or otherwise distort it; that is, the liquid as collected in the nip between the drum and the squeezer roller and deflected by the squeezer rollers 22 and 24 flows into the deflector canalizations 23 and 25, and is then conveyed into the tank 2, without any of the liquid falling onto the fabric.

Downstream of the outlet spreading roller 11 with respect to the fabric direction of advance, a pair of wringing cylinders 30 and 31 are located, with parallel axes to the rotating drum 7; the wringing cylinders 30 and 31 are opposite each other and the scoured fabric is led therebetween such as to remove all the excess water from the fabric. It should be noted, moreover, that in front of the cylinders 30 and 31 a spray nozzle 32 is located which extends parallel with respect to the cylinders 30 and 31, also performing a dual function: the first function being that of re-wetting the fabric as it exits the outer housing 1, whereas the second function performed is a protective one; that is, it prevents the operator from inadvertedly inserting his hands between the cylinders 30 and 31, a very dangerous occurrence. Under the cylinders 30 and 31, a collector tank 33 is placed which collects the scouring liquid wringed off by the cylinders 30 and 31 and recirculates it to the tank 2; if desired, a drain pipe (not shown in the drawing) may be provided to convey the liquid wringed off by the rollers 30 and 31 directly to the outside.

The scouring station comprises, moreover, a pumping means for supplying the scouring liquid to the spray nozzles 20 which is comprised of a pump 40 drawing the scouring liquid from within a filtering assembly 42 which communicates with the tank 2. More specifically, the filtering assembly 42 includes a filter cylinder 43 of the self-cleaning type, along the outer periphery whereof a brush 44 acts to keep the filter clean. The pump 40, as it draws the scouring liquid, already filtered, from within the filter 43, sends the liquid at a given head to the manifold 21 of the spray nozzles 20, thus implementing a practically closed circuit cycle for the scouring liquid.

It should be further added that on the outer housing 1 a front inspection door 51 is provided, as well as a rear inspection door 52, such doors being arranged for either manual or mechanical opening through a motor, in order to provide quick and easy access to the inside of the housing 1, for machine inspection purposes as well as to position the fabric at the start of the scouring operations.

It should be noted, in addition to the above, that the spray tubes 20 are supported by the side walls of the outer housing 1 and closed at the ends thereof by plates 60 which are easily detachable for a quick and convenient tube cleaning operation.

The scouring station further comprises a drive means which is operative to rotate said drum 7 through a belt 70 running around a variable pitch pulley 71 affixed at the drum 7 axis, said drive further rotating the two wringing cylinders 30 and 31; thus a close dependence is achieved between the wringing cylinders 30 and 31 rotational speed and the speed of the rotating drum 7, which is effective to prevent the introduction of undesirable stresses in the fabric as well as an insufficient stretching of the fabric.

An auxiliary motor 80 is further provided, which through a belt drive rotates the spreading rollers 8 and 11.

From the above description, the operation of the whole scouring plant will be evident. At the scouring station, the fabric is spread transversely to its direction of advance through the inlet spreading roller 8, whereafter the fabric runs over the first idle roller 9 and hence the fabric goes over the upper portion of the rotating drum 7 lateral surface, and is then delivered to the second idle roller 10 and from here to the outlet spreading roller 11, wherefrom the fabric is passed to the outlet wringing cylinders 30 and 31.

It should be pointed out here that with the arrangement described above the drum is entirely out of the tank 2, i.e. the drum is not immersed in the scouring liquid, and furthermore it becomes possible to keep the printed side of the fabric facing out, that is facing the spray nozzles 20; this allows the obtainment of an improved scouring action since the effectiveness of the jet is not diminished by having to go through the fabric first, thereby the dye particles and impurities to be removed are are directly impinged upon by the jet, whereafter by passing through the rotating drum 7, which as already mentioned above has a perforated surface, they fall into the tank 2.

The effectiveness of the fabric scouring step is ensured in that the fabric is subjected to a considerable amount of scouring liquid jets which are allowed to easily pass through the fabric without damaging it, since the same is at that portion resting on the rotating drum. Furthermore, the placing of the printed side towards the jets increases, as mentioned previously, the effectiveness of the scouring action to a considerable extent.

The scouring liquid completes its closed circuit cycle by passing through the self-cleaning filters 43, of great effectiveness and long useful life, to return then, through the pump 40, to the spray nozzle members. The fabric, after being dragged by the rotating drum 7, is again tentered or spread by the outlet spreading roller 11 in order to prevent any creases from being permanently pressed in by the wringing cylinders 30 and 31.

From the above-provided description, it will appear that the invention fully achieves the objects proposed, and in particular the fact is underlined that by placing the rotating drum 7 outside of the tank containing the scouring liquid, the risk is eliminated of the fabric coming in contact with any contaminated scouring liquid; in fact, the fabric is exclusively processed with the scouring liquid from the spray nozzles 20, whereto the scouring liquid is delivered after going through the filter element 43.

The invention as such is susceptible to many modifications and variations, all of which fall within the scope of the instant inventive concept. Thus, for example, even though the above detailed description has been referred on the whole to printed fabrics, the scouring station according to this invention may also be utilized for any other type of fabric.

Moreover, all the details may be replaced with other, technically equivalent, elements.

In practicing the invention, the materials used, as well as the dimensions, may be any ones to suit particular applicational requirements.

I claim:

1. A full-width scouring station, particularly for delicate printed fabrics, comprising, an outer casing, a tank within said casing and containing a scouring liquid, means in said tank for defining a maximum liquid level therein, at least one rotating drum having a substantially horizontal rotation axis extending over said tank and arranged entirely above said maximum liquid level, said drum having a perforated cylindrical surface, said cylindrical surface having an upper half and a lower half thereof, guide rollers coextensive with said cylindrical surface arranged at opposite sides of said lower half of said cylindrical surface to guide a fabric around said upper half of said cylindrical surface, a plurality of spray members located above said drum and extending over a sector of said upper half of said cylindrical surface and operative to direct scouring liquid jets onto a fabric portion extending over said cylindrical surface sector, at each opposite sides of said cylindrical surface, between said guide rollers and said sector and at the upper half of said cylindrical surface, a squeezer roller parallel to the axis of rotation of said drum and forming a nip therewith to press and squeeze the fabric against said upper half of the cylindrical surface of said drum thereby to prevent the liquid collected in the nip to seep through the nip, canalization members below said squeezer rollers and coextensive therewith to collect and drain away into said tank the liquid overflowing from said nip over said squeezer rollers and to prevent such liquid to reach the fabric below said squeezer rollers, upstream of said drum and external to said outer housing, an inlet spreading roller for the fabric, downstream of said drum and external to said housing an outlet spreading roller for said fabric, pumping means for supplying the scouring liquid to said spray members and drive means for rotating said drum.

* * * * *